US006364153B1

(12) United States Patent
Petzitillo, Jr. et al.

(10) Patent No.: US 6,364,153 B1
(45) Date of Patent: Apr. 2, 2002

(54) WASTE CONTAINER WITH DISPLACEABLE PANEL CLOSURE

(76) Inventors: Anthony D. Petzitillo, Jr., 12 Hidden Hollow La., Sicklerville, NJ (US) 08081; Todd A. Fowler, 1501 Little Gloucester Rd., Apartment A-2, Blackwood, NJ (US) 08012

( * ) Notice: Subject to any disclaimer, the term of this patent is extended or adjusted under 35 U.S.C. 154(b) by 0 days.

(21) Appl. No.: 09/698,976

(22) Filed: Oct. 27, 2000

(51) Int. Cl.[7] ..... B65F 1/16

(52) U.S. Cl. ..... 220/812; 220/832; 220/833; 220/908

(58) Field of Search ..... 220/908, 811, 220/812, 817, 831, 832, 833, 849

(56) References Cited

U.S. PATENT DOCUMENTS

| | | | | |
|---|---|---|---|---|
| 2,338,477 A | * | 1/1944 | Wolters et al. | 220/812 |
| 2,758,744 A | * | 8/1956 | Spindler et al. | 220/812 |
| 4,821,902 A | | 4/1989 | May | 220/1 |
| 4,853,985 A | * | 8/1989 | Perry | 220/817 |
| 4,878,596 A | * | 11/1989 | Cawley et al. | 220/812 |
| 4,934,562 A | | 6/1990 | Early et al. | 220/1.5 |
| 5,251,775 A | | 10/1993 | Kruzick et al. | 220/331 |
| 5,533,643 A | | 7/1996 | Kruzick | 220/331 |
| 5,639,129 A | | 6/1997 | Lindley | 292/145 |
| 5,755,351 A | | 5/1998 | Kruzick | 220/331 |

* cited by examiner

*Primary Examiner*—Stephen Castellano
(74) *Attorney, Agent, or Firm*—Duane Morris LLP

(57) ABSTRACT

A container with side and end walls, a top and a bottom, has a closure with a panel movable outwardly perpendicular to a plane of the closure, from a closed and substantially sealed position to a closed and substantially unsealed position to disengage the seal before undertaking a more gross opening movement in which the panel is moved clear of the opening. In one embodiment a movable lid covers and seals an opening in a top wall. At least two guides are positioned adjacent to the opening and hold captive rollers of a lid carriage that enable the lid to be moved to either side of the container and tilted clear of the opening. The guides are movable in a direction perpendicular to the closure plane and either lift the lid to disengage the seal or pull the lid downwardly to compress the seal. In another embodiment, a container is provided with a rear or end wall that in its gross movement hinges open and closed to clear or close an opening between container side walls. At least two hinges are mounted between the movable rear wall and a support plate on a sidewall adjacent to the movable rear wall. The support plate is constrained to move perpendicular to the plane of the door opening, shifting the rear wall between a closed and substantially sealed position and a closed and substantially unsealed position. In this manner the seal is subjected only to compression and decompression, with the movable rear wall or top lid in each case being free move open or closed without interference with the seals.

12 Claims, 8 Drawing Sheets

WASTE CONTAINER WITH DISPLACEABLE PANEL CLOSURE

FIELD OF THE INVENTION

The invention relates to containers for cargo such as bulk waste material, especially intermodal containers, and more particularly concerns a container having a closure mechanism with a panel mounted for displacement perpendicular to the plane of the closure, in addition to being mounted for hinging or sliding, to facilitate sealing.

BACKGROUND OF THE INVENTION

Bulk materials, finished products, parts and components, and also waste materials are frequently transported in large containers that preferably seal tightly when closed. Although there are a number of standard sizes, particularly for intermodal containers, a typical container is approximately twenty feet long, six to eight feet wide and four to twelve feet deep.

Such containers advantageously are openable at the top to facilitate loading and unloading. U.S. Pat. No. 5,533,643—Kruzick, for example, discloses a box-like container having a movable top panel or lid that covers an opening occupying a large portion of the top. The lid can be displaced to either side of the container on a roll track, and upended. When closed or moved over the opening, clamps permit the lid and the roll track to be pulled down against the container against spring pressure, for compressing a resilient seal around the perimeter of the opening.

Another container structure is disclosed in U.S. Pat. No. 5,639,129—Lindley, wherein the top of the container is open but an end door provides an alternative path for loading, as well as dumping of the contents by tipping the container at an appropriate site to discharge the contents through the end. The door defines one full end of the container and is attached to the ends of the opposite side walls on a vertical hinge at the end of one side wall, and a latching mechanism at the other side wall.

Containers as described may be subject to very rough handling and must be of a sturdy construction. The two containers cited above are structured much like dumpsters in that they can be pulled onto a carrying vehicle having a ramp or tiltable flat bed, or urged onto a vehicle by backing a tilting support under a container held at a stop. Such containers are frequently pushed about. They may be handled with fork trucks and are sometimes dropped or at least set down very hard in handling. Materials may be dumped violently into the containers when loading. During normal use, damage and misalignment can occur, particularly in the lids and doors, and their associated seals. Damage to the lids, doors or their seals can result in leakage from the container, and ingress of water.

Containers may be designed with standardized fittings that enable alternative ship, rail and road transport. The fittings are positioned to be engaged by standard locating and fixing pins or hooks of a container in a staging area or on a vehicle placed at a defined position. To support the container when moved from a vehicle to the ground, and vice-versa, the container may have slide runners or rails along the bottom or roll-off hoist structures such as undercarriage wheels. For applying the necessary lateral force via a cable, chain or grasper, a post or hook can be secured to the frame or undercarriage of the container, to receive a hook or cable bight, etc.

Whether the container is structured to be moved in one way or another, moving the container, as well as loading and unloading the container, may generate considerable internal force and stress. The container is most capable of resisting forces that might deform the container if the walls and joints of the container are continuous and well braced. The container is vulnerable to deformation to the extent that closures are provided because the closures are discontinuities in the structure of the container. With respect to loading and unloading, the closure areas are also vulnerable to being struck with falling material or bumped and banged by loading and unloading manipulators.

Where a container closure encompasses a structural wall of the container such as the end wall in the Lindley container mentioned above, the closure must be as heavy and durable as a structural wall, and should be mounted to provide secure mechanical connections of the closure panel with the container structures adjacent to each opening. The container closure also needs to maintain an adequate seal, for example a watertight seal. Often, the objects of providing a heavy closure are inconsistent with the need to provide a good seal.

In the case of a container used for potentially hazardous waste, it is particularly important that the door and lid be sealed in a manner that will not permit accidental seepage of the contents. However, for contents that are not generally considered hazardous, a seal may also be important to prevent water from gaining ingress and damaging the contents. For some materials, water in the container may leach chemical agents from the contents, and the leachate can be a problem.

Large waste containers preferably are transportable by rail if desired, where maximum container height limits are set by federal regulations. Height regulations also apply to over-the-road transport. In addition to the foregoing considerations or mechanical strength and effective sealing, it is desirable that any top lid cover the entire top opening in one piece. It is desirable that the lid and the mechanism for supporting the container lid project above the container as little as possible. Another advantageous aspect would be to provide a lid mechanism that can be handled by a single person.

Containers with end door closures are dumped by opening a door at one end of the waste container, and raising the other end of the container so that the contents slide through the open door by gravity. Dumping containers often have a horizontal hinge at the top of a pivoting door panel, which structure is useful in that the hinge mounting structurally supports the container by fixing the distance between the sidewalls adjacent to the door. However, such a door interferes with access for loading and unloading through the end. In the Lindley container, the hinge axis is vertical. The door is hinged to one of the container sidewalls and is latched to the other. This arrangement places substantial stress on the hinge-side container sidewall. The weight of the door is cantilevered. When the door is pivoted to or near to the closed position, the weight of the door produces a force tending to sway the container hinge axis inwardly and cause the door to droop across the opening. As the door is swung open or closed, the direction of the swaying force varies, stressing the side wall. When the door is closed, it is necessary for the latch side to engage securely to support the weight of the door.

Moreover, the relative movement of a vertically hinged door panel wears the seals. Releasing the latching engagement of the door can result in damage to the seal as the disengaged door panel drops downwardly around a point at the bottom of the door hinge axis. As the door drops at the latch side, the portions of the door and container defining the seal grind over one another in the plane of the end opening. Such grinding wear on the seal is difficult to avoid. Even if the vertically hinged door does not droop at all, the motion of the door panel is rotational about its hinge axis. Rotation around the hinge axis translates into at least a slight relative displacement in the plane of the opening, namely displacement of the door panel relative to a seal strip on the ends of the container side walls (or vice versa) as the seal is compressed. The relative motion is perpendicular to the opening only at the precise point at which the door panel is at the nominal closed position, typically perpendicular to the container side wall. The seal is engaged by the door panel over an arc of the door panel as the door panel contacts and then compresses the seal, which grinds at the seal.

There is a need for a simple, durable and reliable mechanism for permitting the cover or lid of a large container to be easily manipulated between a locked and sealed position and an open position clear of the corresponding container opening, while optimizing sealing. There is also a need for a relatively durable end closure that can provide a reliable seal in a variety of conditions and which is easily used without normal operation causing undue wear on the seal.

SUMMARY OF THE INVENTION

According to an inventive aspect, a container that comprises a plurality of sidewalls, a top and a bottom, is provided with a sealing closure in at least one of the walls or portion of the top, comprising a door or panel that is mounted for movement perpendicularly inwardly and outwardly of the closure plane, for moving between a closed-but-unsealed position and a closed-and-sealed position, and additionally is provided with a gross mounting structure for moving the door panel more generally from the closed-but-unsealed position to an open position substantially clear of the opening.

In one embodiment of the invention, a container is provided that comprises sidewalls, a bottom wall, and a top wall defining an opening. A movable lid that is sized to cover and sealingly close the opening is positioned upon the top wall. At least two guides are positoned on the top wall adjacent to the top opening, spaced apart from one another and movable between a first position and a second position. A carriage is mounted on the lid which rides upon the guides wherein the guides and the carriage cooperate to enable the lid to move between (i) a closed and substantiallly sealed position corresponding to the first position of the guides and (ii) a closed and substantially unsealed position corresponding to the second position of the guides wherein the lid is free to be slid upon the guides. The lid can slide or roll on the guides, and preferably is carried on rollers that are captive in the guides, above and below, and permit the lid to be moved to either side and upended to open the container. Preferably, the guides are displaceable either pulled down onto container seals or lifted from the seals for movement without interference with or from the seals.

In another embodiments of the invention, a container is provided that comprises a plurality of walls bounding a volume wherein one of the walls defines a door panel that is movable so as to define an opening into the volume. At least two hinges are mounted between the door or movable sidewall and a support plate, and enable displacement of the hinge axis along a line perpendicular to the closure plane of the opening. The support plate is located on a sidewall adjacent to the moveable sidewall or door, and is moveable between a first position and a second position thereby enabling the movable sidewall to shift to between (i) a closed and substantially sealed position corresponding to the first position of the support plate and (ii) a closed and substantially unsealed position corresponding to the second position of the support plate.

The lid in the first embodiment and the movable sidewall or door in the second embodiment are independently movable toward and away from the closure plane to engage or disengage the seal, and via their respective guides or hinges to clear the opening in a manner that does not interfere with the seal.

BRIEF DESCRIPTION OF THE DRAWINGS

These and other features and advantages of the present invention will be more fully disclosed in, or rendered obvious by, the following detailed description of the preferred embodiment of the invention, which is to be considered together with the accompanying drawings wherein like numbers refer to like parts and further wherein.

DETAILED DESCRIPTION OF THE PREFERRED EMBODIMENT

Figure 1:
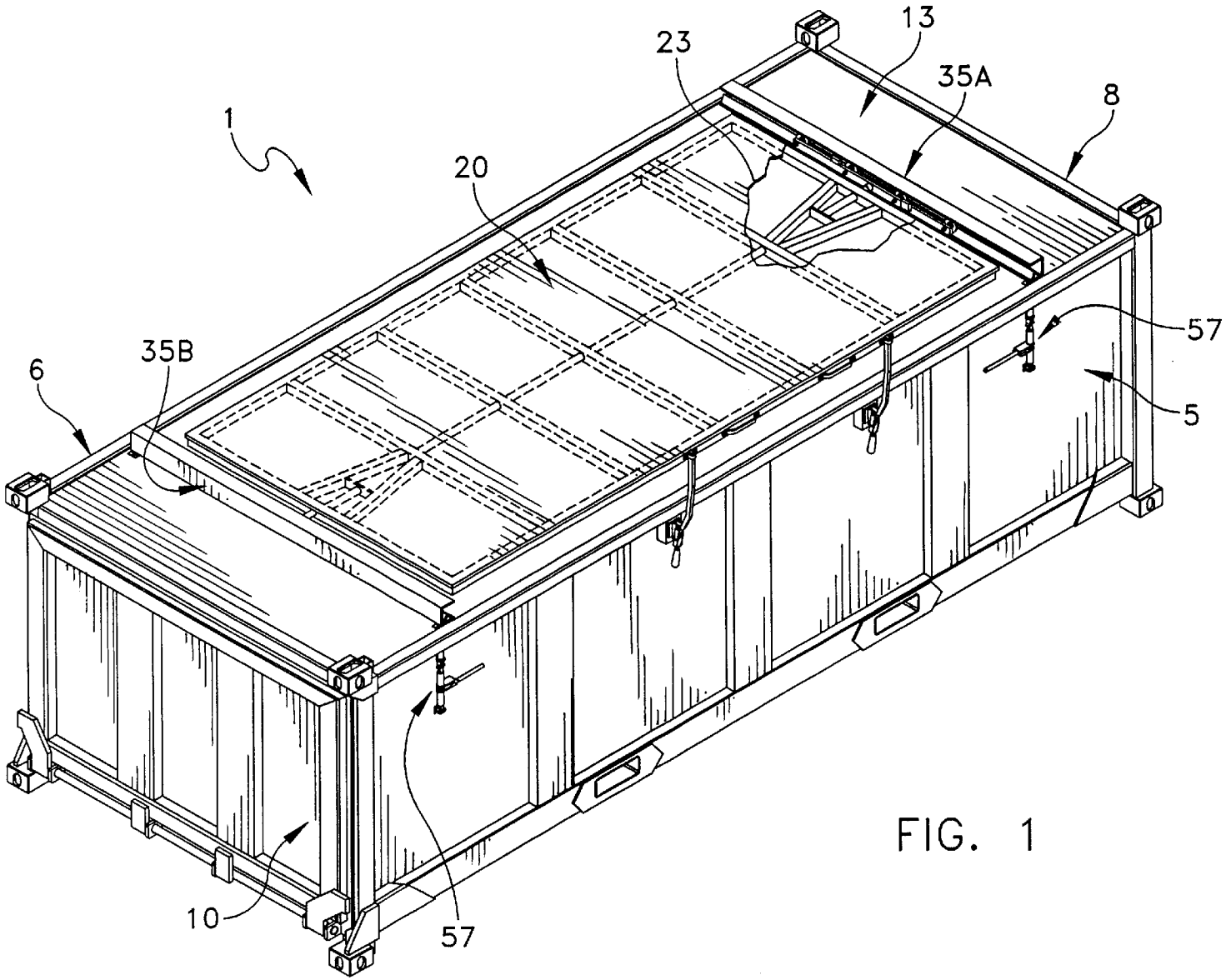
FIG. 1 is a perspective view of a container formed in accordance with the present invention.

This description of preferred embodiments is to be read in connection with the accompanying drawings, which are part of the entire written description of this invention. In the description, corresponding reference numbers are used throughout to identify the same or functionally similar elements. Relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and are not intended to require a particular orientation unless specifically stated as such. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship.

FIG. 1 shows an inventive container 1, comprising side walls 5 and 6, a front wall 8, a rear wall 10, a top wall 13 and a bottom, all of which are arranged so as to enclose a void space or volume that is sized and otherwise outfitted for storing or transporting various materials or items, such as bulk materials, finished products, parts and components, waste materials and the like. The container is particularly apt for storing materials or items that are advantageously isolated in the volume by seals.

Figure 5:
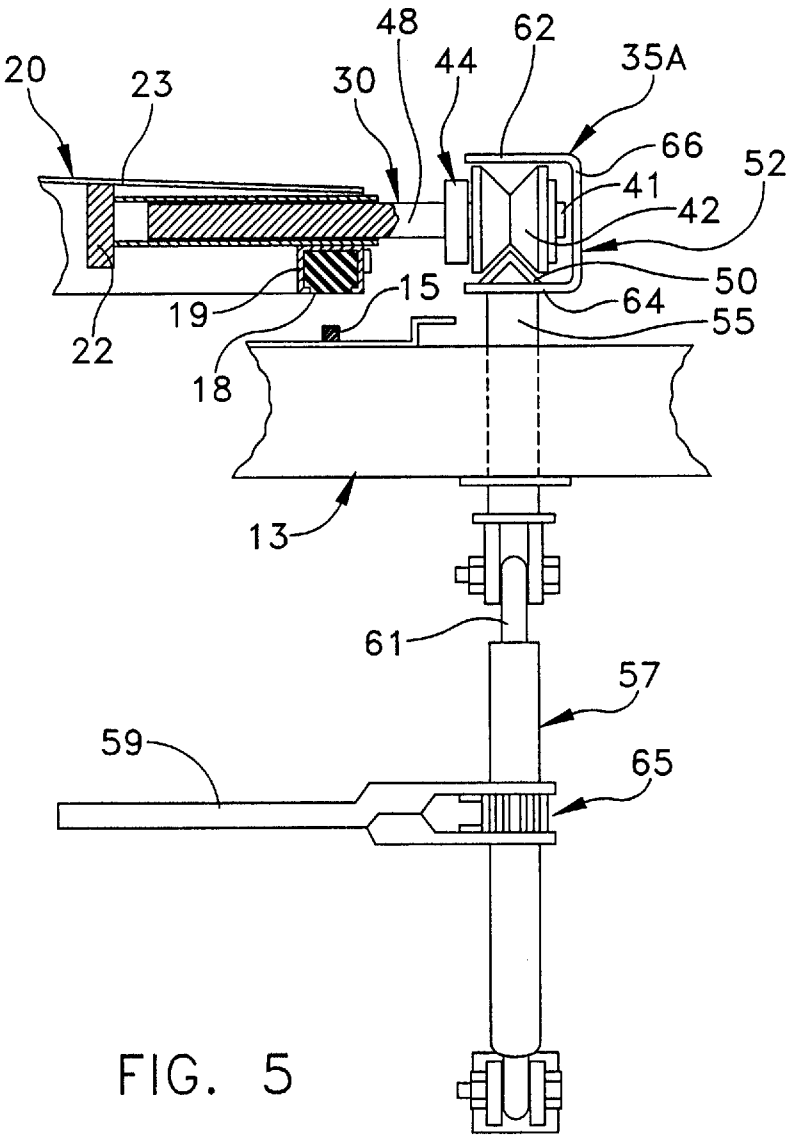
FIG. 5 is a broken-away, front elevational view of a ratchet binder of the type used in connection with the present invention, shown in a second position.
Figure 4:
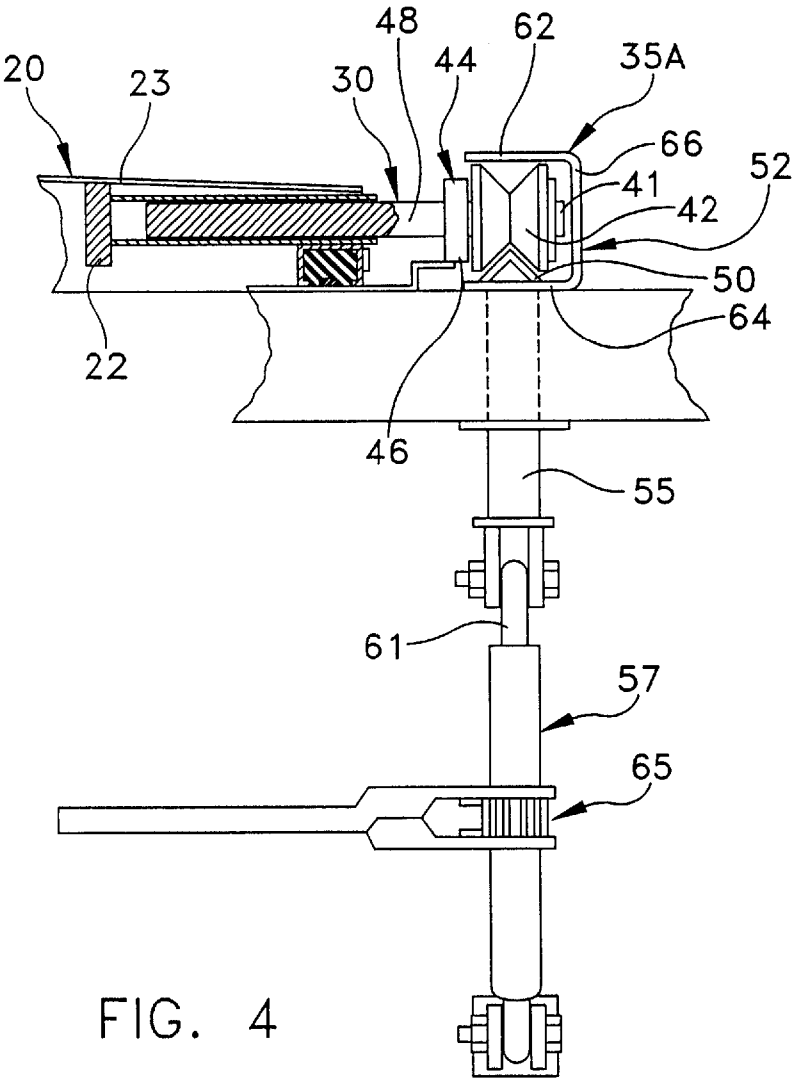
FIG. 4 is a broken-away, front elevational view of a ratchet binder of the type used in connection with the present invention, shown in a first position.
Figure 6:
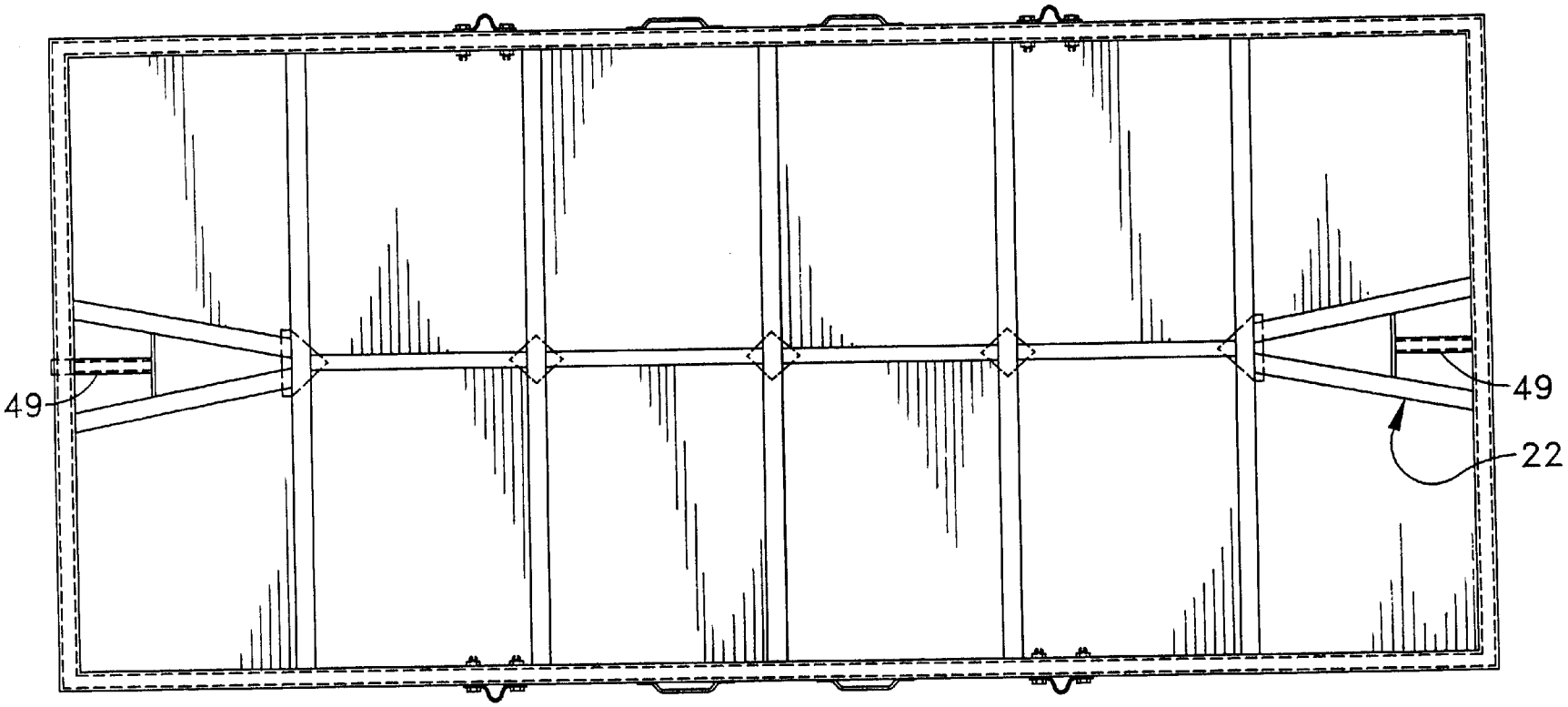
FIG. 6 is a bottom view of a lid used in connection with one embodiment of the present invention.
Figure 7:
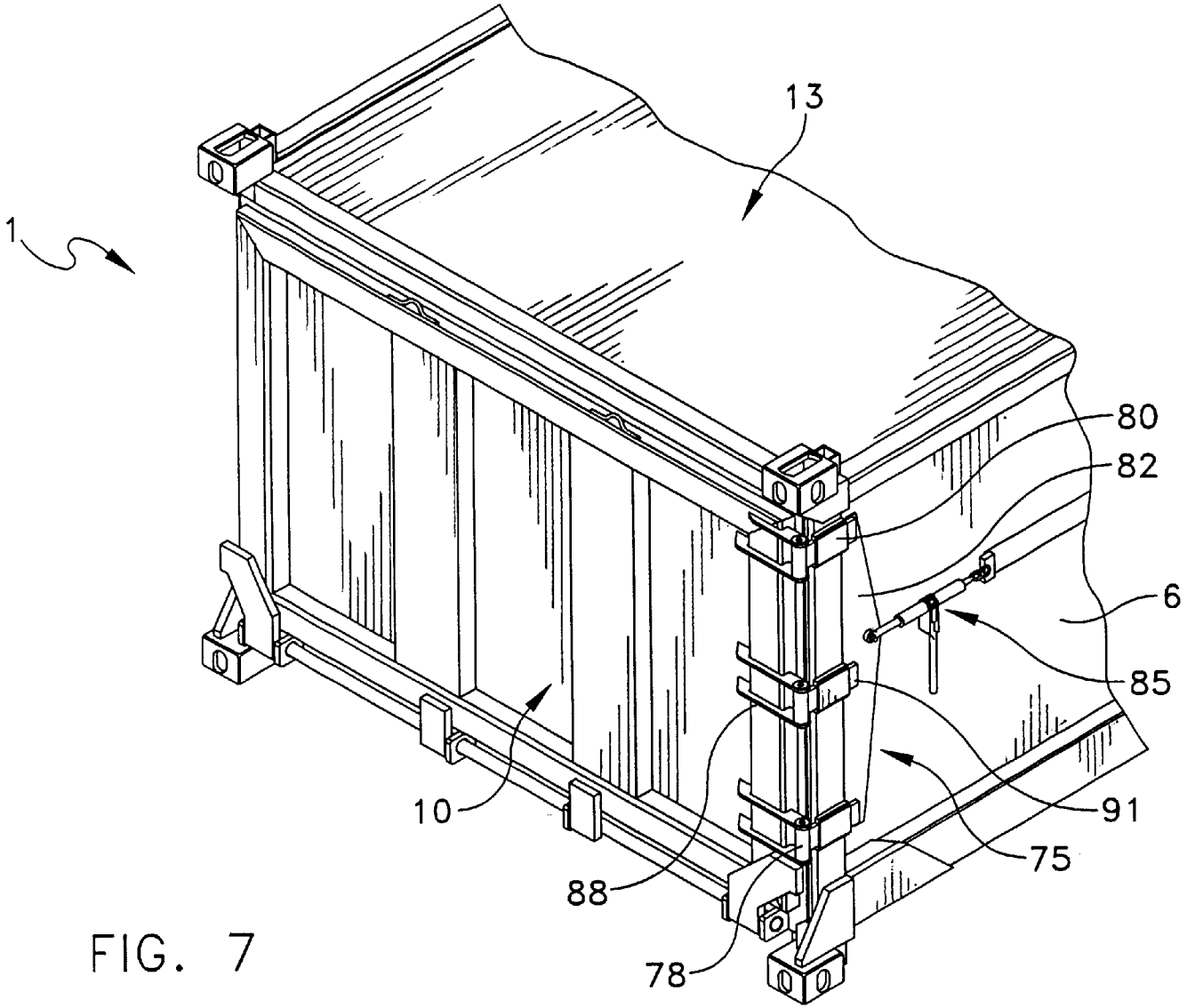
FIG. 7 is a broken-away, perspective end view of a container formed in accordance with another embodiment of the invention.
Figure 8:
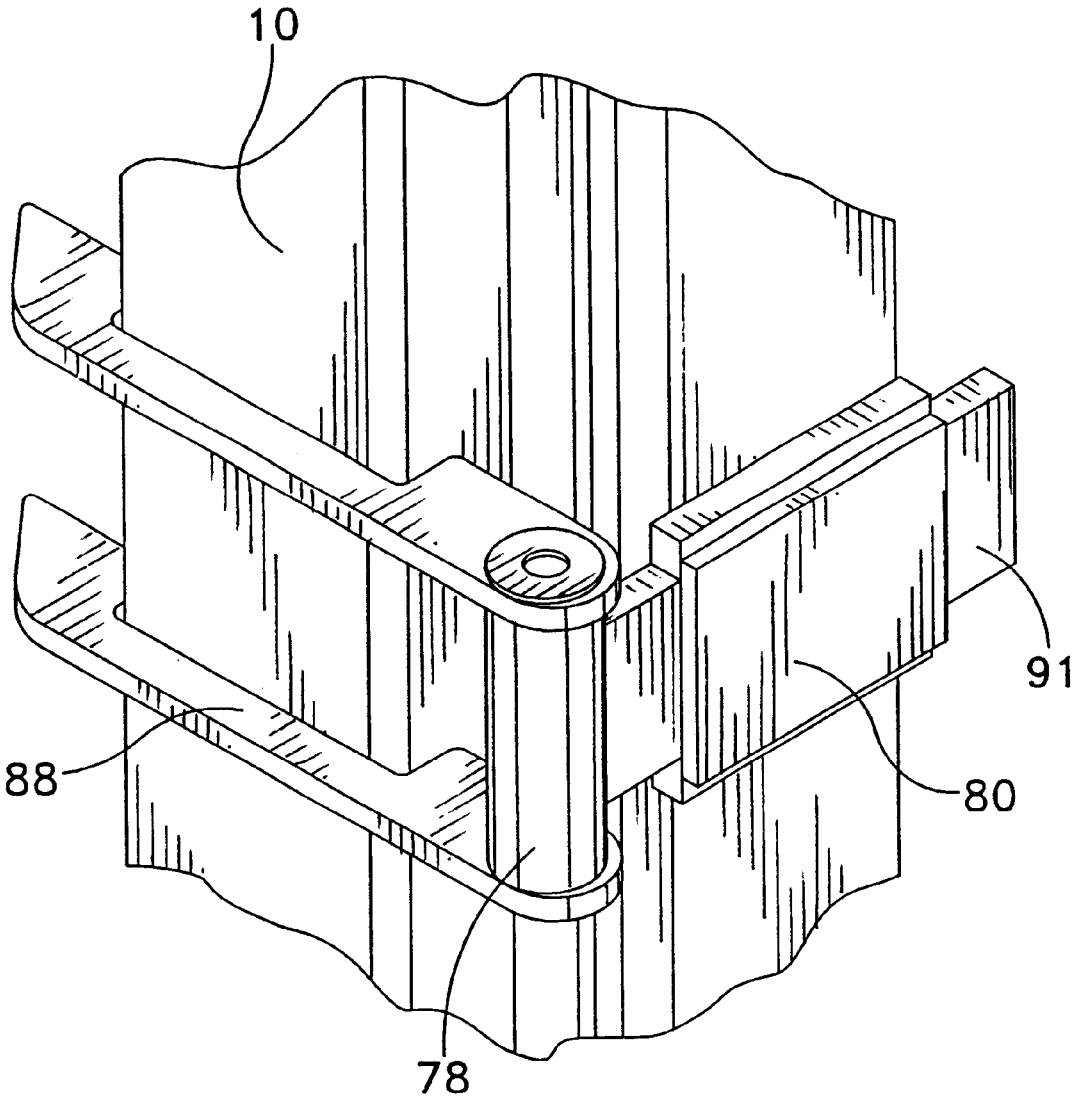
FIG. 8 is a broken-away, perspective view of a hinge and hinge guide.
Figure 9:
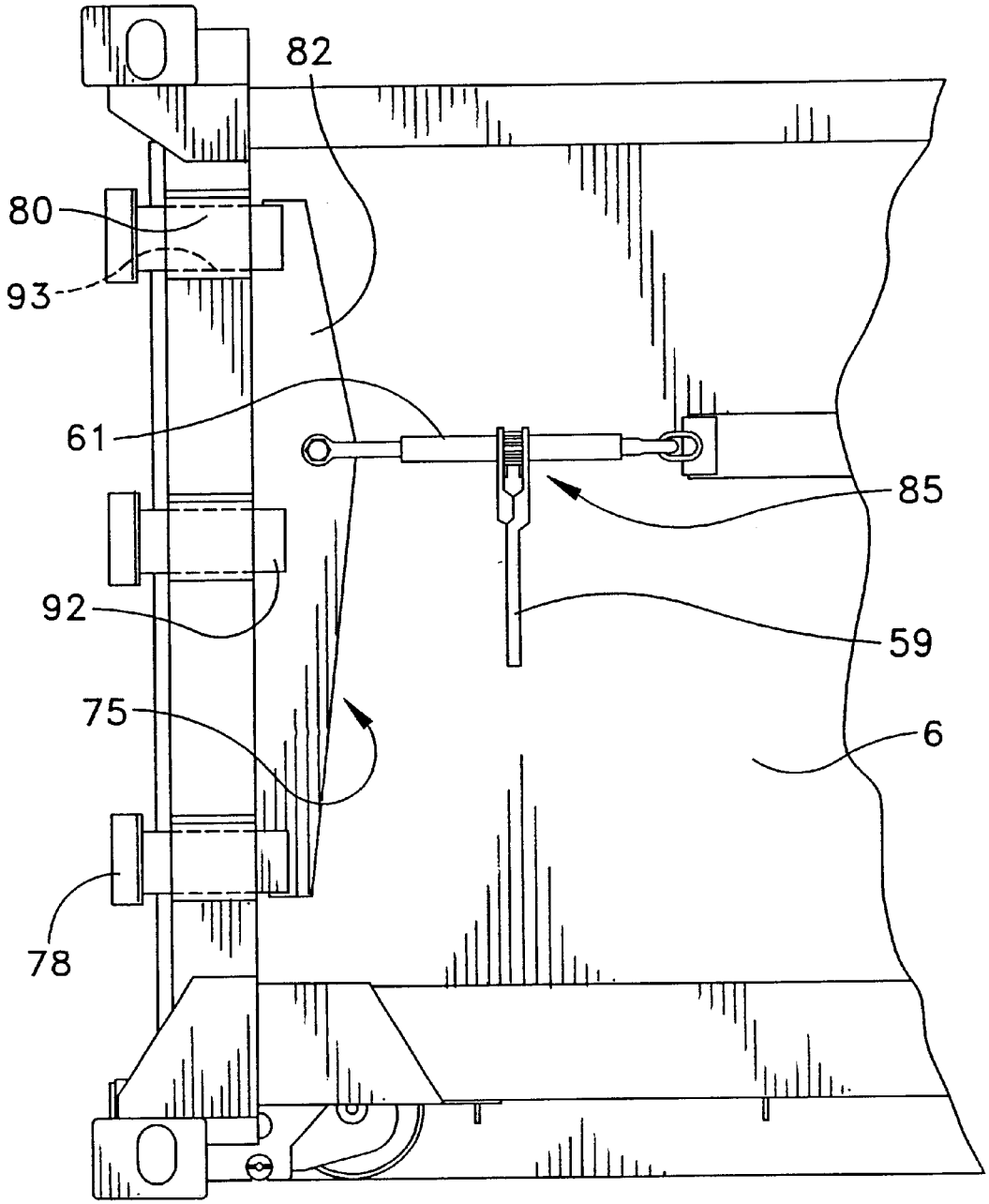
FIG. 9 is a broken-away, side elevational view of a hinge assembly formed according to the embodiment of the invention shown in FIG. 7.

Container 1 is typically made of a high structural strength material, such as steel or the like, and can be rectilinearly shaped, e.g., having a rectangular profile in plan, as well as side and end elevation. Other shapes, including arbitrary shapes, and other materials are possible. Top wall 13 defines an opening and includes a movable panel or lid 20 that is sized to cover and sealingly close the opening. Lid 20 is typically rectilinear, and occupies nearly the full width and a portion of the length of the top of the container. A lip 15 projects upwardly from top wall 13 around the perimeter of the opening facing lid 20, and is preferably formed from a yieldable seal material, e.g., an elastomeric seal, (FIGS. 4 and 5). It is also possible to place the seal on the lid rather than the lip, or to provide both the lid and the lip with a seal.

Lid 20 is preferably rectilinearly shaped, and has a support frame 22 and a cover sheet 23. These can be constructed of light-weight materials so as to be easily moved by hand or low-power motor. For example, the lid components can comprise aluminum sheet material and rectangular tubing. The lid can be constructed to define an arc or crown whereby the sheet material is rounded downwardly and outwardly slightly to shed water. An annular seal receptacle 19 may be located on its bottom surface, adjacent to its peripheral edges, and positioned in corresponding relation to lip 15 of top wall 13. Annular seal receptacle 19 is sized and shaped to house an elastomeric gasket or seal 18. In its broadest aspects, the invention provides at least one wall (typically rear wall 10 or lid 20) that is arranged so as to be movable first outwardly from sealing engagement, in a direction perpendicular to the central volume and the plane of the closure leading thereto, and then either slides or is pivoted while thus disengaged from the seal, so as to provide gross access and egress to and from the central volume. In this way the movable wall or lid can be moved between a closed and substantially sealed position and a closed and substantially unsealed position, prior to being moved to a fully open position so as to form an entrance into the volume. As a result, wear on the seal is minimized.

Referring to FIGS. 1–6, an embodiment of the invention is shown wherein a carriage assembly 30 is mounted to the lateral underside edges of lid 20, carried on displaceable guide tracks 35 A, 35 B, that are mounted on top wall 13 of container 1. Carriage assembly 30 and displaceable guide tracks 35 A, 35 B cooperate with one another to enable lid 20 to move between a closed and substantially sealed position and a closed and substantially unsealed position (FIGS. 4 and 5 ). More particularly, carriage assembly 30 includes a plurality of rollers 42 that are mounted to individual axles 41 on a frame 44. Frame 44 comprises a support beam 46 and a pivot rod 48. Pivot rod 48 extends outwardly from support beam 46 and preferably is substantially centrally located under lid 20. A pivot socket 49 is provided in frame 22, and is located on each lateral edge of lid 20. Pivot socket 49 is sized and shaped to pivotally receive pivot rod 48. In this way, rollers 42, frame 44, and lid 20 cooperate with guide tracks 35 A, 35 B to be moved in unison laterally across top wall 13 of container 1 to expose the opening to the central volume. It will be understood that rollers 42 may comprise wheels of any type, or a non-rolling, i.e., sliding, mechanism may be used that provides for low-friction movement of carriage assembly 30 along guide tracks 35 A, 35 B.

Displaceable guide tracks 35 A, 35 B are movably mounted adjacent to the edges of the opening in top wall 13, with each including a track 50, a collar 52, at least two shafts 55, and at least two ratchet-binders 57. Each track 50 has an elongated rail or the like having a cross-sectional shape that is complementary to the outer profile of rollers 42. For example, in one embodiment track 50 comprises an inverted angle iron having an orientation and shape that complements a gap or spacing in "V"-groove rollers 42 (FIGS. 4 and 5). In this way, rollers 42 of carriage assembly 30 are confined to roll along and be guided by track 50, and tend to resist racking because gravity urges the rollers to center themselves laterally on the angle iron rail. Collar 52 is a generally open-ended, channel-shaped structure including an upper sidewall 62, a lower sidewall 64, and a web 66. Track 50 is mounted on the inside surface of lower sidewall 62, and collar 52 is oriented so that track 50 is accessible to rollers 42 of carriage assembly 30. In other words, collar 52 is oriented so that rollers 42 may be placed in rolling engagement with track 50, with frames 44 positioned between collar 52 and lid 20.

Figure 2:
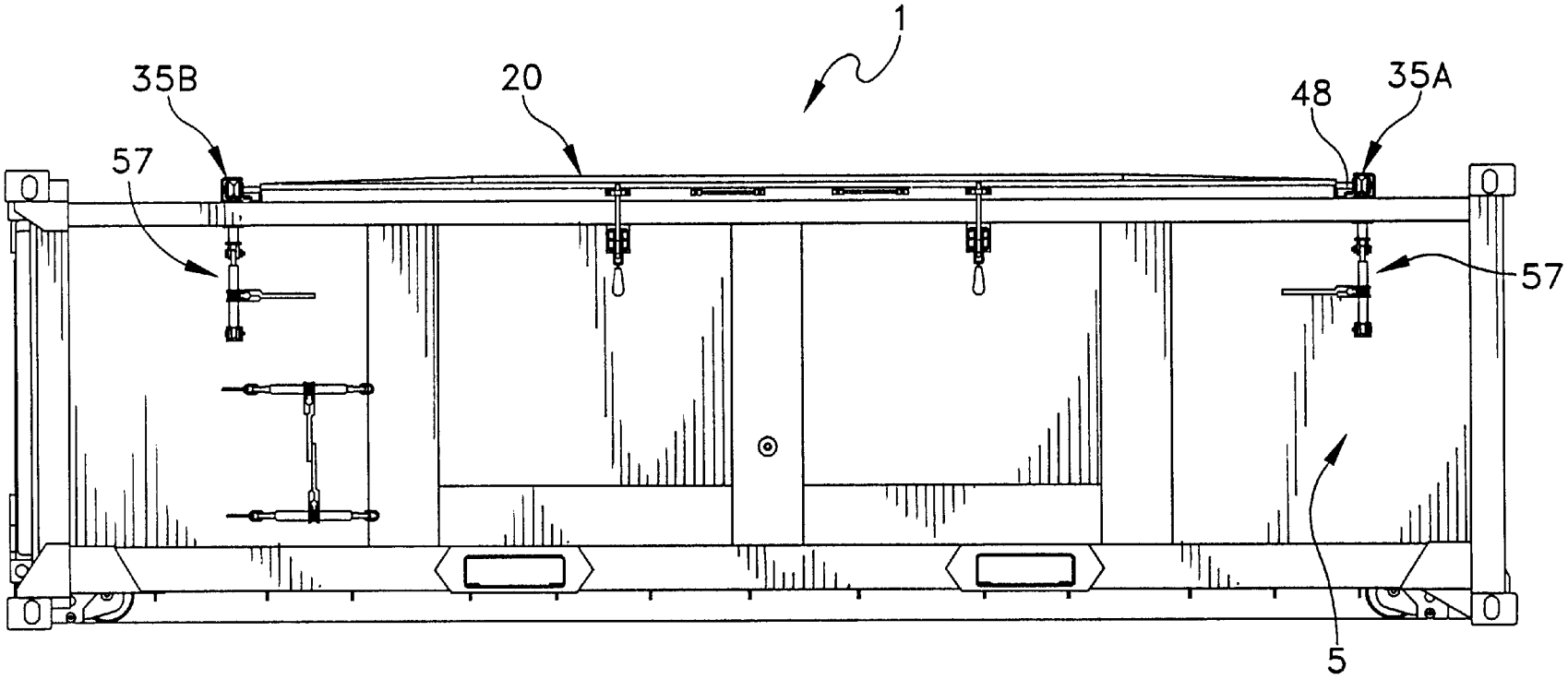
FIG. 2 is a side elevational view of the container shown in FIG. 1.
Figure 3:
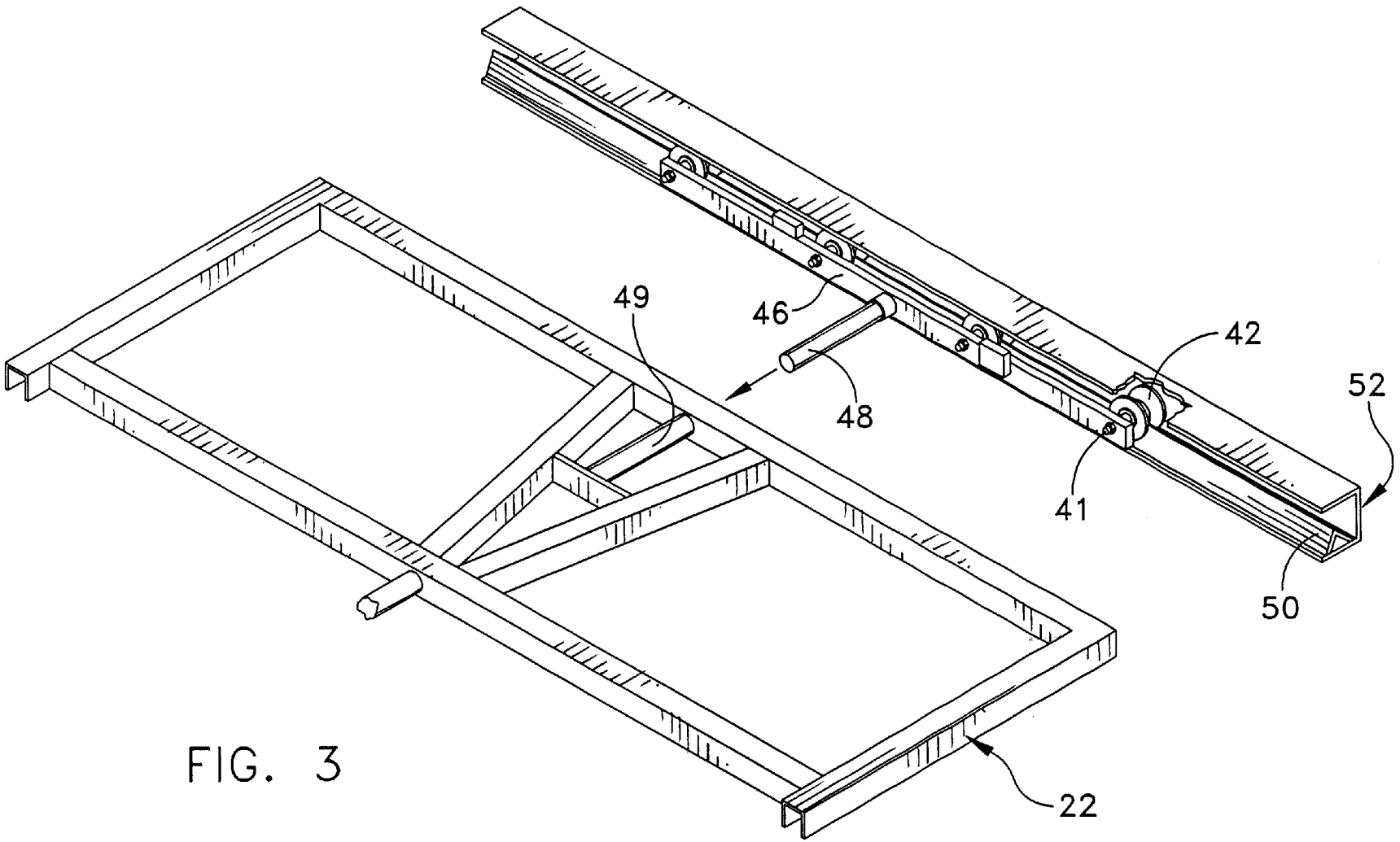
FIG. 3 is a perspective view of a carriage assembly, guide track, and a portion of a lid frame structure.

Referring to FIGS. 2, 4, and 5, each shaft 55 projects downwardly from the bottom surface of lower sidewall 64, and through an opening defined in a flanged edge portion of top wall 13. Shaft 55 operatively engages a ratchet-binder 57 mounted on the outside surface of sidewalls 5 and 6. Ratchet binders 57 are of the type that are well known in the art for applying or releasing a measured and regulated amount of tension to a binding member, such as a rope, cable, shaft, or the like, by converting rotational movement driven by ratcheting or reciprocating a handle 59, into extension or retraction of a shaft and eyelet member 61. Typically, handle 59 is interconnected to a ratcheted gear assembly 65, including a direction control switch mechanism, which allows for the application or release of tension with the same ratcheting movement of handle 59, depending upon the state of the switch.

As a result of this construction, when ratchet binder 57 is operated so as to extend member 61, shaft 55 moves upwardly lifting collar 52 off of top wall 13 and thereby lifting carriage assembly 30 and lid 20 upwardly and away from top wall 13 by means of the "V"-shaped rollers. As this occurs, seal 18 is disengaged from annular seal receptacle 19, placing lid 20 and carriage assembly 30 in an unsealed position where it is free to be moved laterally, across top wall 13 so as to expose the opening into container 1. The upward progress of shaft 55 may be halted by either stopping actuation of ratchet binder 57 or by engagement of a stop plate on the shaft with the peripheral underside edge of top wall 13. Once lid 20 is moved across top wall 13 by a predetermined distance, lid 20 may be pivoted upwardly, from one end, about pivot rod 48, in a known manner, such that the lid resides on the container side wall entirely clear of the opening. Preferably the lid is bidirectionally movable in this manner, whereby the lid can be displaced to and pivoted upwardly alongside either of the opposite container sidewalls.

A reversal of the foregoing procedure lowers lid 20 onto top wall 13 and re-engages seal 18 in annular seal receptacle 19. More particularly, lid 20 is slid laterally across top wall 13 by a predetermined distance so as to place lid 20 directly over top of the opening in the container. Preferably the rails are provided with depressions forming detents for the "V"-rollers at a position in which the lid 20 is aligned with the opening in the container. Ratchet binder 57 is then operated so as to retract member 61, moving shaft 55 downwardly, and lowering collar 52 onto top wall 13. In this way, carriage assembly 30 and lid 20 are lowered substantially perpendicularly downwardly and toward top wall 13. As this occurs, seal 18 re-engages annular seal receptacle 19. In this way, lid 20 can be moved between a closed and substantially sealed first position (with seal 18 engaged in annular seal receptacle 19) and a closed and substantially unsealed second position (with seal 18 disengaged from annular seal receptacle 19) prior to being moved to a fully open position so as to form an entrance into the volume of container 1. According to the structure shown, "V"-rollers 42 are captive in guide rails 35 A, 35 B, namely between track 50 and upper sidewall 62. Thus, foreshortening the ratchet binders not only permits the lid and seal to engage by gravity, but also can be used to pull the lid downwardly against the seal. This securely locks and seals the lid in place.

Referring to FIGS. 1 and 7–9, another embodiment of the present invention is shown, this time in connection with an end or rear wall 10. Rear wall 10 is movably mounted to the end of container 1 by a rear carriage assembly 75 comprising at least two hinges 78, a hinge guide 80, a hinge transfer plate 82, and a rear ratchet binder 85. Hinges 78 are of a conventional design, and are preferably of the type normally used for intermodal container doors. Each hinge 78 includes a door mount 88 and a wall mount 91 that are pivotally interconnected at their intersection. Door mount 88 is fixedly attached to rear wall 10 and wall mount 91 is fixedly attached to hinge transfer plate 82. Wall mounts 91 comprise beams that are sized and shaped to be slidingly received within correspondingly shaped passageways 93 defined through hinge guide 80. Passageways 93 are defined transversely through each hinge guide 80 in equi-spaced relation to one another along the length of hinge guide 80. Hinge transfer plate 82 is substantially planer in shape, and has each wall mount 91 fastened to it along an edge adjacent to hinge guide 80, with rear ratchet binder 85 fastened to it along central location along the edge that is spaced from hinge guide 80.

Hinge transfer plate 82 and the plural spaced hinge wall mounts 91 are rigidly attached to plate 81. The hinge wall mounts 91, each of which forms one of the leaves of a hinges 78 and are constrained to move only along parallel tracks defined by hinge guides 80, form a hinge mounting structure that is only capable of moving in a direction perpendicular to the closure plane of the end wall or door 10, namely in a plane parallel to sidewall 6. Whereas the hinge wall mounts 91 move as a unit and remain guided in hinge guides 80, it is possible to displace the pivot axis of the end wall or door perpendicular to the closure plane. However the structure does not permit the uppermost hinge wall mount 91, for example, to be advanced outwardly any farther than the lowermost hinge wall mount 91. Thus structure thereby resists the tendency of the cantilevered weight of the door to droop due to the freedom of the hinge axis to move inwardly and outwardly perpendicular to the plane of the closure.

Ratchet binder 85 is of the same type as ratchet binder 57, i.e., of the type that is well known in the art for applying or releasing a measured and regulated amount of tension to a binding member, such as a rope, cable, shaft, or the like, by converting rotational ratcheting movement of a handle 59 into an extension or retraction of a shaft and eyelet member 61. Ratchet binder 85 is fastened to hinge transfer plate 82 by eyelet member 61 (FIG. 9) and to sidewall 6 of container 1. As a result of this construction, hinge transfer plate 82 is movable between a first fully retracted position and a second fully extended position. Movement between the first and second positions enables door or rear wall 10 to shift between a closed and substantially sealed position and a closed and substantially unsealed position. More particularly, as ratchet binder 85 is actuated, so as to move hinge transfer plate 82 toward hinge guide 80, hinges 78 move outwardly and longitudinally away from the central volume of container 1. In this way, rear wall 10 is moved outwardly and away from sidewalls 5, 6, top wall 13 and the bottom of container 1. Once rear wall 10 is in its second position, it is free to pivot about hinges 78 and swing open and closed for entrance and egress to and from container 1.

In addition to the depicted mounting on the hinge side of door or end wall 10, a latch mechanism (not shown) can be provided on the container side wall opposite from the hinge side, and another ratchet binder (also not shown) can be provided on that side to urge the distal or free side of the door toward the closure plane. The latch mechanism can include an inclined plane block that receives a latch pin block protruding from the free edge of the door to provide additional vertical support. In addition, lower edge clamps can be provided to pivot against the bottom edge of the door panel in known manner.

According to each of the embodiments of the invention, a fine or final displacement is provided for moving a closure panel into (or out of) engagement with the seal from a closed-but-unsealed position at which the closure panel is free of interference with or from the seal. This displacement involves mountings that constrain the motion of the closure panel to a direction perpendicular to the plane of the closure. From this closed-but-unsealed position, the closure panel can operate in a coarse but durably configured manner and can comprise heavy duty component parts that can readily bear stresses placed on the container in use.

The invention has been described with respect to certain preferred embodiments, but the invention is not limited only to the particular constructions disclosed and shown in the drawings as examples, and also comprises the subject matter and such reasonable modifications or equivalents as are encompassed within the scope of the appended claims.

What is claimed is:

1. A container comprising a plurality of walls arranged so as to enclose and define a volume wherein at least one of said walls comprises a top wall including at least two edges having a plurality of rollers mounted on each of said at least two edges;

at least two guide tracks spaced apart from one another and each movably mounted on one of said plurality of walls wherein said guide tracks are positioned within a collar comprising an open-ended channel-shaped structure including an upper sidewall, a lower sidewall, and a web, wherein each of said guide tracks is mounted on an inside surface of said lower sidewall, and said collar is oriented so that said guide track is accessible to said plurality of rollers so that said rollers may be placed in rolling engagement with said guide track when positioned between said collar and said top wall, and wherein each of said plurality of rollers matingly engages a portion of one of said guide tracks so that said guide tracks cooperate with said rollers so as to move said top wall perpendicularly and away from said volume between a closed and substantially sealed position and a closed and substantially unsealed position, and wherein said top wall is free to open and form an entrance into said volume from said closed and substantially unsealed position.

2. A container according to claim 1 wherein said guide track comprises an elongate rail having a cross-sectional shape that is at least partly complementary to an outer profile of each of said plurality of rollers.

3. A container according to claim 1 wherein said guide track comprises an inverted angle iron having an orientation and shape that complements a central groove in each of said plurality of rollers so that each roller is confined to rolling along and guided by said track.

4. A container comprising:

sidewalls, a bottom wall, and a top wall defining an opening;

a movable lid sized to cover and sealingly close said opening;

at least two guides positioned on said top wall adjacent to said opening, spaced apart from one another and movable between a first position and a second position wherein said guides each include a track, a collar, at least two shafts, and at least two ratchet-binders; and a carriage mounted on said lid so as to ride upon said guides wherein said guides and said carriage cooperate to enable said lid to move between (i) a closed and substantially sealed position corresponding to said first position of said guides and (ii) a closed and substantially unsealed position corresponding to said second position of said guides wherein said lid is free to be slid upon said guides.

5. A container according to claim 4 wherein one of said lid and said top wall includes an annular seal receptacle and the other of said lid and said top wall includes an annular seal, the receptacle and the seal respectively being located on one of a bottom surface of the lid adjacent to a peripheral edge of the lid and an upper surface of said top wall adjacent to a peripheral edge of the opening, the seal and the receptacle being positioned to engage.

6. A container according to claim 5 wherein said lid is arranged so as to be movable first outwardly, perpendicular to a plane of the opening, and then laterally of the container, to provide access and egress to and from said central volume.

7. A container according to claim 4 wherein said carriage includes a plurality of rollers that are rotatably mounted on a frame, said frame comprising a support beam and a pivot rod that extends outwardly from said support beam.

8. A container according to claim 7 wherein said lid includes a frame structure having a pivot socket located on each lateral edge of said lid, and sized and shaped to pivotally receive said pivot rod.

9. A container according to claim 4 wherein said track comprises an elongate rail having a cross-sectional shape that is at least partly complementary to an outer profile of said rollers.

10. A container according to claim 9 wherein said track comprises an inverted angle iron having an orientation and shape that complements said rollers so that said rollers are confined on opposite sides of the rollers to roll along and be guided by said track.

11. A container according to claim 4 wherein said collar comprises an open-ended channel-shaped structure including an upper sidewall, a lower sidewall, and a web, wherein said track is mounted on an inside surface of said lower sidewall, and said collar is oriented so that said track is accessible to said rollers so that said rollers may be placed in rolling engagement with said track when positioned between said collar and said lid.

12. A container according to claim 11 wherein each of said shafts project downwardly from a bottom surface of said lower sidewall, and through an opening defined in a flanged edge portion of said top wall.

* * * * *